US005465774A

United States Patent [19]

Smith

[11] Patent Number: 5,465,774

[45] Date of Patent: Nov. 14, 1995

[54] SLIDING GLASS DOOR PRIVACY SCREENS

[76] Inventor: Mary A. Smith, 41 Parkside La., Bayonne, N.J. 07002

[21] Appl. No.: 225,617

[22] Filed: Apr. 11, 1994

[51] Int. Cl.[6] ..... E06B 3/32

[52] U.S. Cl. ..... 160/90; 160/368.1; 160/371; 49/70; 40/611

[58] Field of Search ..... 160/90, 371, 368.1; 40/611, 594; 49/70

[56] References Cited

U.S. PATENT DOCUMENTS

| | | | |
|---|---|---|---|
| 3,858,638 | 1/1975 | Soeffker | 160/222 X |
| 4,103,728 | 8/1978 | Burdette et al. | 160/368.1 |
| 4,133,367 | 1/1979 | Abell | 160/368.1 |
| 4,398,586 | 8/1983 | Hall | 160/368.1 X |
| 4,453,585 | 6/1984 | Ruggeberg, Sr. et al. | 160/368.1 X |
| 4,486,990 | 12/1984 | Bauch | 49/61 X |
| 5,025,848 | 6/1991 | Prochaska | 160/368.1 |

*Primary Examiner*—Blair M. Johnson

[57] ABSTRACT

A decorative window covering provides privacy on sliding glass doors or windows without altering the walls surrounding the door or window. These privacy screens are functional as well as decorative, are removably attached to the window or door, and can remain within a sliding window or door frame when opening or closing the window or door.

1 Claim, 2 Drawing Sheets

SLIDING GLASS DOOR PRIVACY SCREENS

BACKGROUND OF THE INVENTION

1. Field of the Invention

The present invention relates generally to decorative window treatments and, more particularly, is concerned with a privacy screen adaptable to sliding glass doors or any framed sliding window. The privacy afforded by these screens provides, as much, if not more, than any type of conventional drapery, shades or blinds.

2. Description of the Prior Art

In the recent years, there has been a tremendous growth in new home building and home renovation and, as such, the various providers of home related products has expanded greatly. Such highly promoted home improvement articles include sliding glass doors that allow more convenience and attractive access to deck and patio areas. The unexplored area of providing convenient and attractive window coverings to these sliding windowed doors is a method or invention that is to be described. No other article of manufacture exists that creates such an efficient and simple method of providing decorative privacy for sliding glass doors. Presently, and prior to this time, achieving any level of privacy to sliding doors called for the use of a vertical blind system attached over the door frame of the sliding door structure and necessitated the constant manual repositioning of these blinds when entering or exiting the sliding doors.

Although the vertical blind system ("verticals"), or variations of it, has been used extensively with sliding glass doors, it does have drawbacks. To be utilized, these blinds must be installed and therefore, screwed into the existing walls causing alteration to the home. The "verticals" also must be drawn back and forth when walking through the doors and if not, the verticals can sustain damage. The vertical blinds hide the natural beauty of the sliding door frame itself and if not fully closed do not provide total privacy.

Consequently, a need exists for a new and innovative method of providing a privacy covering for sliding glass doors.

SUMMARY OF THE INVENTION

The present invention provides privacy with a decorative as well as multi-functioned advantage. The screens or inserts are removable, lightweight, can be either translucent or opaque (depending on the desired covering material) and can be stored when not placed on the window frame. Such storage can either be behind a piece of furniture or the panel can be hung upon a wall as a decorative show piece since the article is lightweight and easily movable. The inserts, used in pairs, must be built on a rectangular frame to fit within the sliding doors window area. The frame is fitted with material that can have any color scheme or any type of artwork that will conform to the desired interior decorating. The type of fabric used can also contain variations although a stretchable spandex, when attached over the framework offers a pleasant translucency for daytime use and an opaque quality at night. Additionally, although the artwork is rendered on the inside of the insert (i.e. facing into the dwelling), when interior lighting is on (at night), the design is clearly observable from the exterior of the dwelling.

The spandex covering, when painted with acrylic paint, can be removed from the framework and washed and hung to dry. The covering is form fitted over the frame and attached to the underside of the frame with Velcro® stripping. When correctly in place, the insert fits snugly and flush to the window frame of the sliding door so that the inserts may remain within the doors and slide past each other when the doors are opened and closed. There would be no need to remove these inserts or to make any adjustment to them when utilizing the sliding doors. The inserts can be easily removed by the user at the users discretion since the frame structure itself is held in place by Velcro® placed inconspicuously in the corners of the window of the sliding door.

The framing can most easily be constructed of wood, however, other types of rigid building material may be used. The wood frame can be protected with either paint, varnish or polyurethane to prevent warpage. The fabric covering is tailor-fitted on the corners of the frame and attached to the rear of the frame with mating Velcro®. This bond is hidden and not seen from either side of the door.

The wood (or other rigid substance) is comprised of ⅝" finishing wood with tongue and grove corners. The width of the wood is crucial to the performance of the panels, since if the width is too wide, the panels will not clear the sliding of the doors.

So that the framework remains rigid, a crossbeam is situated on the lower half of the framework and of course, is of the same thickness as the rest of the frame. The placement of the crossbeam on the lower half of the frame is designed so it will not be noticeable at eye level. The crossbeam is also most effective with tongue and groove construction. Prior to placing the panels in place, it is necessary to apply glue-on Velcro® to the four corners of the window panel. The soft side of the Velcro® is attached to the fabric. The coarse side of the glue-on Velcro® is set on the window pane. With the Velcro® in place the panel will sit squarely and flush within the frame work of the window.

DESCRIPTION OF THE PREFERRED EMBODIMENTS

Figure 1:
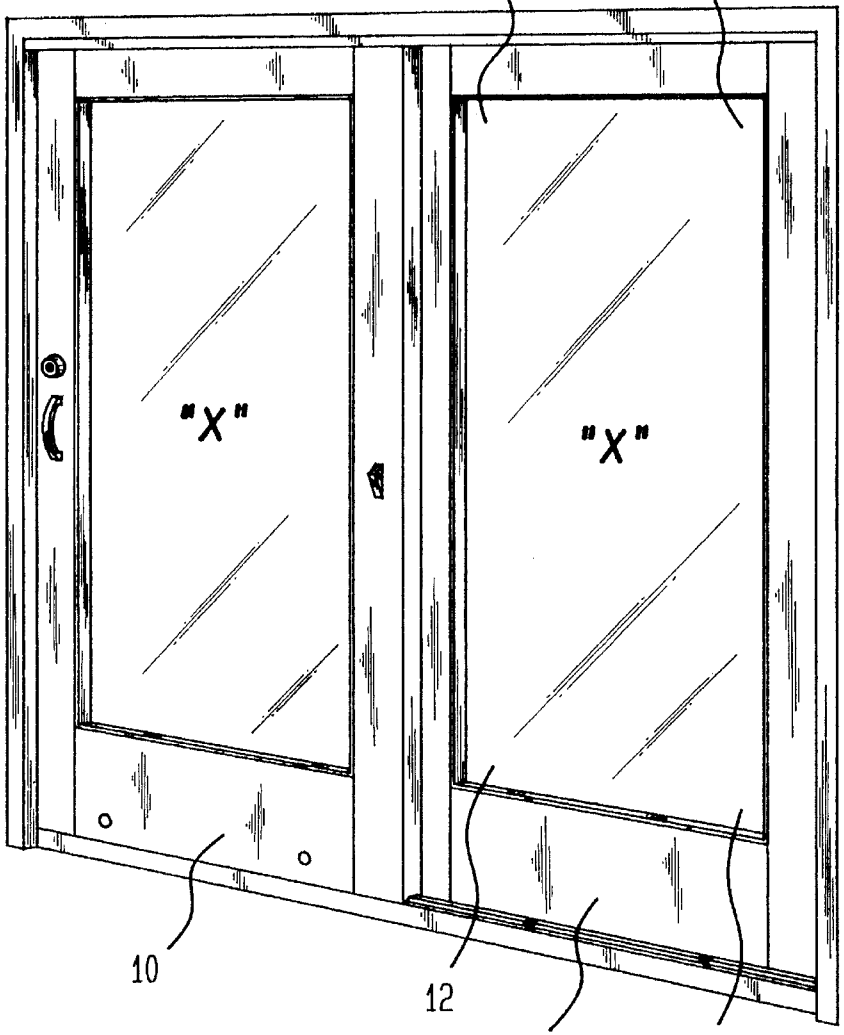
FIG. 1 in a perspective view which depicts sliding doors and areas marked by an "X" in the area within which the Sliding Glass Door window coverings would be placed.

Referring now to the drawings, and more particularly to FIG. 1, there is shown an interior view of a sliding door whereby in this example the left hand door 10 would slide to the right past the stationary 11 right side door. The area marked "X" is the inset glass pane wherein the privacy screens would be placed. The placement of the coarse glue-on Velcro® is noted at the 12 corners of the left window area. The placement of these Velcro® patches would of course, be on the corners of both windows of the door.

Figure 2:
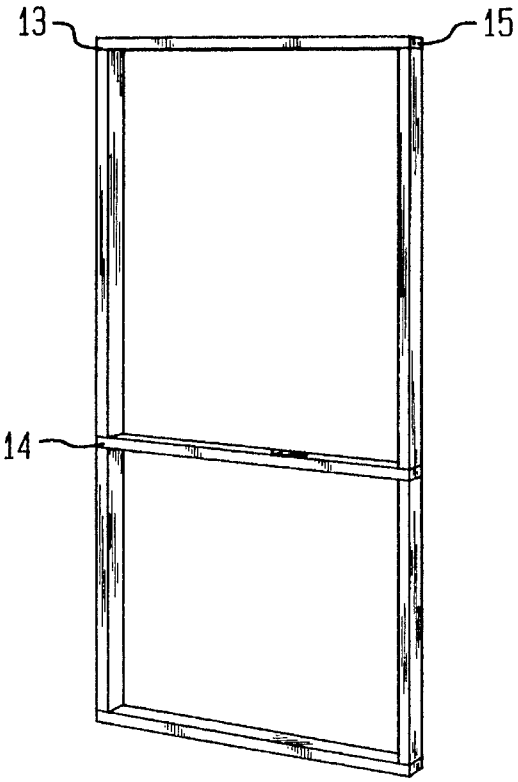
FIG. 2 is a perspective view of framework which details the tongue and groove construction and placement of the crossbeam.

FIG. 2 is the three dimensional framework of the privacy screen which would be covered with the appropriate covering (i.e. Spandex) and placed within the glass area of the sliding doors. The wood or other rigid material, which is tongue and groove 13 at the corners, would be no thicker than the depth of the windows, which on standard sliding doors would be ⅝ of an inch.

The crossbeam 14 location is situated on the lower half of the framework and again has a tongue and groove construction 14 for assuring ridigness of the overall design of the frame.

The spandex (or other type of covering) would be tight-fitted over the frame and again is best attached with Velcro® to the underside of the framework. Thereafter, the soft side of the glue-on Velcro® would be attached to the underside of the corners 15 of the covered frame and allow the placement and attachment to 12 the coarse Velcro® already in place on the windows of the doors.

Figure 3:
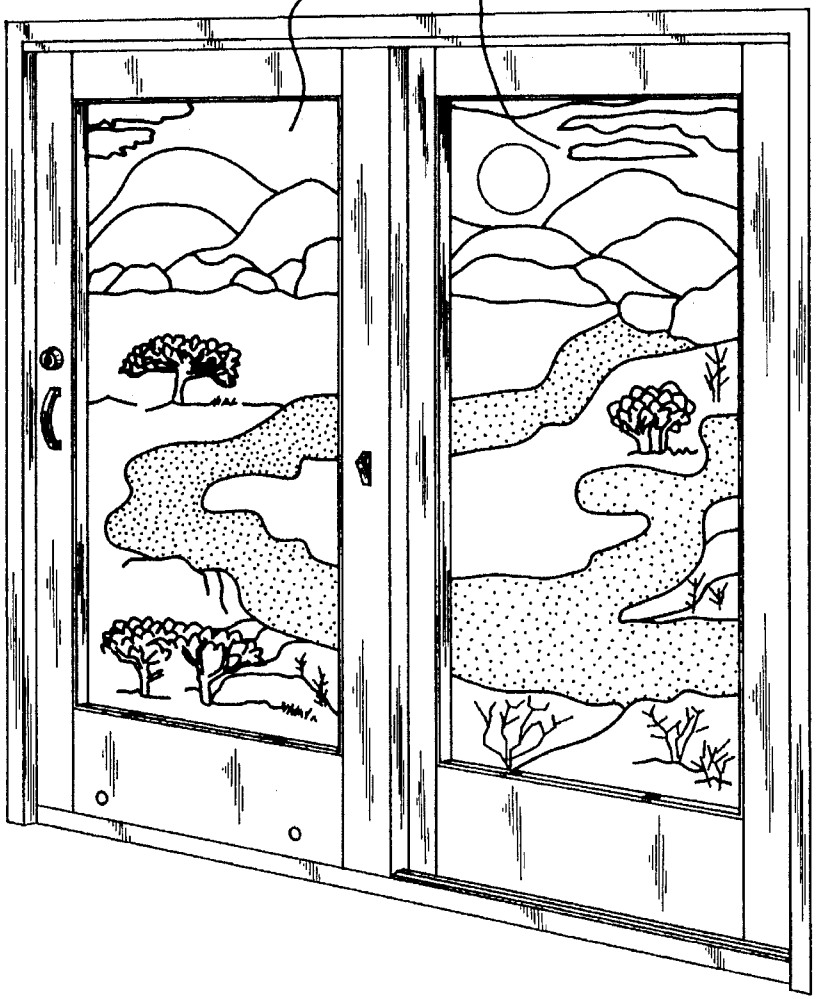
FIG. 3 in a perspective view showing the screens in place on the closed Sliding Doors (showing sample pattern).

FIG. 3 depicts the screens on the frames, in place 16 on the windows of the sliding doors. A sample design of artwork is shown. The artwork, colorscheme and type of design on the covering will vary to conform to the interior decorating.

Figure 4:
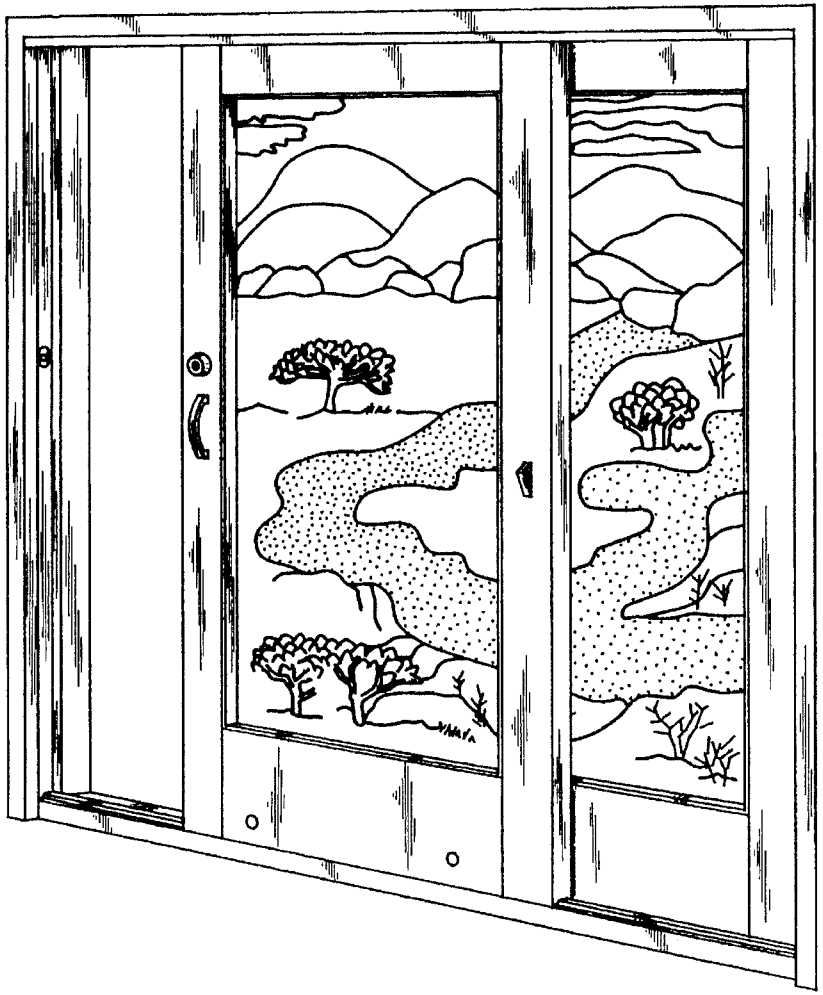
FIG. 4 depicts a persepctive view of the Screens in place on Sliding Doors which are open.

FIG. 4 shows the privacy screens in place and the sliding door in the open position. Noted is the usefulness and uniqueness of the ability to slide the door without the removal of the covered framework while in place on the windows of the doors.

I, Mary Ann Smith, claim:

1. A sliding closure in combination with a privacy screen comprising:

at least one closure member comprising a substantially rigid first frame having opposed outer surfaces and inner edges defining a perimeter, and a transparent panel located within said first frame and extending between said perimeter, said panel being recessed with respect to at least one of the outer surfaces of said frame, one portion of each of a plurality of fasteners being fixed at spaced locations on said transparent panel;

at least one screen member comprising a second frame and a flexible decorative sheet fitted thereon, said sheet being of a material to at least partially prevent viewing therethrough, said second frame being substantially the same size as said transparent panel and having the other portion of said fastener fired at spaced locations on said covered fragile corresponding to the locations of the portion of said fastener fixed to said transparent panel, said second frame has a thickness equal to or less than the recess dimensions of said closure member, wherein, said second frame is removably mounted on said first frame by said fasteners such that said second frame is located within said perimeter and does not extend beyond a respective said outer surface.

* * * * *

UNITED STATES PATENT AND TRADEMARK OFFICE

CERTIFICATE OF CORRECTION

PATENT NO. : 5,465,774
DATED : November 14, 1995
INVENTOR(S) : Smith

It is certified that error appears in the above-indentified patent and that said Letters Patent is hereby corrected as shown below:

Column 4, line 15, " fired" should be -- fixed --.

Column 4, line 16, "fragile" should be -- frame --.

Signed and Sealed this

First Day of July, 1997

Bruce Lehman

*Attest:*

BRUCE LEHMAN

*Attesting Officer*

*Commissioner of Patents and Trademarks*